United States Patent [19]

Egoshi et al.

[11] Patent Number: 4,834,165

[45] Date of Patent: May 30, 1989

[54] COLLAPSIBLE CORE AND METHOD FOR PRODUCING THE COLLAPSIBLE CORE FEASIBLE FOR HIGH SPEED HIGH PRESSURE CASTING

[75] Inventors: Yoshiaki Egoshi, Fuchu; Hideto Sasaki, Chiyoda, both of Japan

[73] Assignee: Ryobi Ltd., Hiroshima, Japan

[21] Appl. No.: 225,201

[22] Filed: Jul. 28, 1988

[30] Foreign Application Priority Data

Aug. 3, 1987 [JP] Japan ..... 62-194926
Aug. 17, 1987 [JP] Japan ..... 62-204847

[51] Int. Cl.[4] ..... B22C 3/00
[52] U.S. Cl. ..... 164/14; 164/138; 164/369; 164/33
[58] Field of Search ..... 164/14, 138, 33, 516, 164/517, 518, 519, 72, 369, 23, 24

[56] References Cited

U.S. PATENT DOCUMENTS 3,903,950 9/1975 Lirones ..... 164/518
4,413,666 11/1983 Page .

FOREIGN PATENT DOCUMENTS 58-176050 10/1983 Japan ..... 164/33

*Primary Examiner*—Kuang Y. Lin
*Attorney, Agent, or Firm*—Oliff & Berridge

[57] ABSTRACT

Disclosed is a collapsible core for use in a casting and a method for producing the collapsible core. The collapsible core comprises a main core body, a first layer formed over the core body, a second layer formed over the first layer, and a third layer formed over the second layer. The second layers includes a thermosetting resin such as low temperature decomposable resin. The low temperature decomposable resin comprises one of urea resin and phenol resin. The thermosetting resin is applied to the first layer by dipping, spraying or brush-painting. This thermosetting resin provides tight bonding to the neighbouring layers.

21 Claims, 3 Drawing Sheets

COLLAPSIBLE CORE AND METHOD FOR PRODUCING THE COLLAPSIBLE CORE FEASIBLE FOR HIGH SPEED HIGH PRESSURE CASTING

BACKGROUND OF THE INVENTION

The present invention relates to a collapsible core and a method for producing the collapsible core feasible for high pressure casting such as a die casting and squeeze casting (cast forging).

In an ordinary high pressure casting such as die casting etc., a metallic core is used to increase its mechanical strength so as to withstand high pressure. However, it would be rather difficult to remove such metallic core from a casted material after casting, particularly in case of an intricate cores. Therefore, the core having relatively simple configuration is only available for the die casting, and therefore, casting products undergo restrictions in terms of its variety in shape.

To overcome this problem, a collapsible core has been proposed instead of the metallic core. However, such collapsible core would be detrimental to mechanical strength, surface peneteration with molten metal such as aluminum, collapsibility after foundry, and quality of casting surface of the product. Therefore, the conventional collapsible core would be lack of a commercial feasibility.

Various researches and development have been made to overcome the drawbacks in the conventional collapsible core. It would be rather difficult to summarize such R & D, but fundamentally, coating layers are formed on an external surface of a core body, and the tequniques are disclosed in Japanese Patent Publication Nos. 57-59013 and 60-15418 and Japanese Laid Open Patent Publication No. 59-45054.

According to the publications 57-59013 and 60-15418, dual layers are provided over the core body. That is, a first layer "b" formed of refractory material mixed with resin is provided over the surface of the core body, and a second layer "a" formed of mica is provided over the first layer as shown in FIG. 1. In this construction, since bonding strength between the first and second layers is insufficient, the second layer "a" may be washed out by turbulent melted metal flowing at high speed in the die casting machine. As a result, the core undergoes metal penetration.

Further, the first layer includes resin having high resistance to heat, and the sand core is subjected to deep penetration with the resin. Therefore, after foundry, the core may not be easily collapsible, and the resin must be heated at high temperature for its decomposition, i.e., so called sand baking step is required. However, in the die casting method which provides high speed casting with turbulent molten metal flow, blisters on casting may occur due to the sand baking step. The blisters on casting causes degradations in external appearance, dimensional accurcy, and shape of the casted product, and therefore, the sand baking step should not be applied.

Accordingly, the conventional collapsible core is only available for special type of casting method where molten metal passes through a gate at extremely low flowing velocity. Therefore, it would be almost impossible to widely use the conventional collapsible core in various casting manners.

SUMMARY OF THE INVENTION it is therefore an object of the persent invention to overcfome the above-described drawbacks and disadvantages and to provide an improved collapsible core and a method for producing the collapsible core for use in a high speed high pressure casting such as a die casting.

Another object of this invention is to provide such collapsible core and the method for producing the same, in which the core can withstand high speed high pressure casting, yet capable of prompt core collapsing upon completion of the casting.

Still another object of this invention is to provide such collapsible core and the method in which core collapsing and removal is easily facilitated without sand baking step at high temperature after casting.

Briefly, and in accordance with this invention, there is provided a collapsible core for use in a casting comprising a main core body, a first layer, a second layer, and a third layer. The main core body is formed of refractory materials and at least one of organic binder and inorganic binder. The first layer is formed over an external surface of the main core body, and contains refractory material powders. The second layer is formed over the first layer and includes thermosetting resin. The third layer is formed over the second layer, and is formed of at least one of flaky graphite, mica and metallic powder.

Further, a method for producing a collapsible core for use in a casting according to this invention comprises the steps of: (a)preparing a main core body formed of refractory materials and at least one of organic binder and inorganic binder; (b)preparing a first slurry formed of a mixture of refractory material powders and a first solvent; (c)providing the first slurry over the main core body for forming a first layer over the main core body, (d)drying the first layer; (e)applying a mixture of a resin material and a second solvent onto the first layer for forming a second layer over the first layer; (f)preparing a second slurry formed of a mixture of a third solvent and at least one of flaky graphite, mica and metallic powders; (g)dipping the main core body formed with the first and second layers into the second slurry prior to complete curing of the second layer for providing a third layer over the second layer; and, (h)heating and curing the second and third layers.

The thermosetting resin in the second layer is penetrated into the first and third layers, so that tight bonding results between first and third layers through the second layer. When the composite collapsible core is used, these layers are not washed away by molten metal, and no penetration of the molten metal into these layers occurs. Further, since no sand baking process is performed, disadvantageous blisters on castings may not occur in the present invention, and excellent dimensional accuracy and stability are obtainable. Furthermore, since the second layer is not deeply penetrated into the main core body through the first layer, because of mere dipping, spray-coating or brush-painting step, high collapsibility after casting is attainable.

DETAILED DESCRIPTION OF THE PREFERRED EMBODIMENTS

Figure 5:
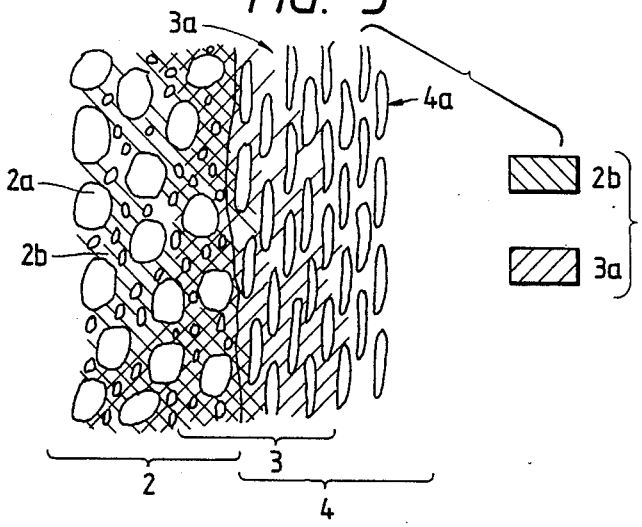
FIG. 5 is an enlarged cross-sectional view showing coating layers according to the first embodiment of the present invention.

A first embodiment according to this invention will be described with reference to FIGS. 2 thru 5. A core 1 includes a core body 1*a*, an internal first layer 2 formed over the outer surface of the core body 1*a*, an intermediate second layer 3 formed over the first layer 2, and an external third layer 4 formed over the second layer 3. Reference numeal 5 generally indicates these layers 2, 3 and 4. As best shown in FIG. 5, the core body 1*a* is formed of a refarctory material and one of organic binder and inorganic binder. The first layer 2 is formed of a mixture of pulverized refractory material 2*a* and low temperature decomposable resin such as urea resin 2*b*. The second layer 3 is formed of thermosetting resin 3*a* such as for example urea resin and phenol resin. The third layer 4 is formed of at least one of mica, graphite (flaky graphite), and metallic powders 4*a*.

For producing the core 1, a first slurry is prepared which is a mixture of pulverized refractory material and urea resin solution etc., and a core body 1*a* is dipped into the first slurry for 2 to 3 seconds, and then the core 1*a* is taken out from the first slurry and is heated at a temperature of about 60° to 160° C. for about 10 to 20 minutes. Therefore, the first slurry is cured and serves as the first internal layer 2. Thereafter, thermosetting resin solution such as phenol and urea resin solution is formed over the first layer 2 by dipping, spraying or brush coating. The urea resin solution may includes water, and phenol resin solution may includes alcohol. A water content or alcohol content in the thermosetting resin solution is evaporated while the resin solution is not completely cured, so that the second intermediate layer 3 is formed over the first layer 2. In other words, the evaporation of the solvent is controlled so as to avoid complete curing of the second layer for the subsequent process of making the third layer. A second slurry which mainly contains one of flaky graphite, mica and metallic powders is prepared. The core body formed with the first and second layers is dipped in the second slurry for about 2 to 3 seconds, and then taken out from the second slurry and is heated at a temperature of 150° to 180° C. for about 10 to 20 minutes. As a result, the third layer 4 is formed over the second layer.

With the structure and method according to this embodiment, the thermosetting resin soltion 3*a* serves as binder, so that the thermosetting resin solution 3*a* is penetrated into the urea resin solution 2*b* of the internal layer 2 as shown by cross-hatching line in FIG. 5. Therefore, the intermediate layer 3 is tightly bonded to the innermost layer 2. Further, the thermosetting resin solution 3*a* is also penetrated into the outermost layer 4 at the dipping step. As a result, the intermediate layer 3 is also tightly bonded to the outermost layer 4 as shown by hatching line in FIG. 5. Accordingly, the neighbouring layers provides high bonding strength to each other. It should be noted that the low temperature decomposable resin such as urea resin is easily decomposed upon injection of molten aluminum because of its heat, and therefore, resultant core provides high collapsibility after foundry.

Various examples according to this embodiment will next be described.

EXAMPLE 1

Figure 3:
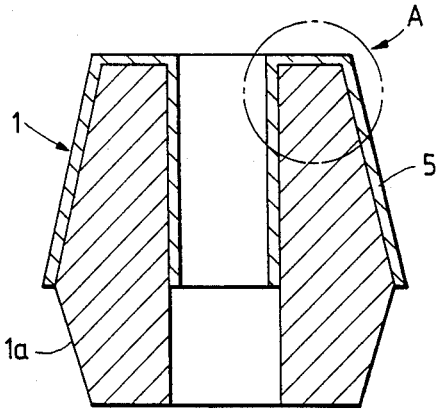
FIG. 3 is vertical cross-sectional elevation taken along the line III-III of FIG. 2.

A core body 1*a* having a configuration shown in FIG. 3 was prepared. The core body 1*a* was formed of resin-coated sands which comprises 100 parts by weight of zircon sand having AFS Fineness No. 60, and 0.8 part by weight of phenol resin. The core body 1*a* provided collapsing strength of 40kgf/cm$^2$. The core body 1*a* was dipped into a first slurry for 3 seconds. The first slurry compositions were as follows:

zircon sand flour (having average particle size of 1 μm): 50 parts
zircon sand flour (having average particle size of 10μm): 20 parts
water: 20 parts
60% of urea resin water solution: 10 parts
defoaming agent: several drips
sulfosuccinic acid sodium: 0.2 parts The core 1*a* coated with the first slurry was taken out and was heated at the temperature of 140° C. for 20 minutes for providing the first layer 2.

Then, 20% of urea resin solution was sprayed onto the first layer 2, and the sprayed layer was left as it was at the temperature of 80° C. for 10 minutes for evaporating part of water, so that the second layer 3 which was not completely cured was formed over the first layer 2.

Thereafter, the core formed with dual layers was dipped into a second slurry for 2 seconds. The components of the second slurry were as follows:

flaky graphite: 30 parts
stainless steel powders: 10 parts
synthetic mica: 15 parts
sulfosuccinic acid sodium: 0.2 parts
water: 50 parts
defoaming agent: several drips Then the core was taken out from the second slurry and was heated at a temperature of 160° C. for 10 minutes for curing the second slurry, to thereby provide the third layer 4 over the second layer 3. As a result, a resultant core 1 shown in FIGS. 2 and 3 was provided.

Thus obtained core 1 was disposed in a metal mold cavity of a die casting machine (800 tons), and molten aluminum alloy (ADC10) having temperature of 660° C. was casted at casting pressure of 460 kgf/cm$^2$ and at plunger speed of 2 m/sec.(molten metal velocity of 45m/sec.) into the mold cavity.

After foundry or casting, the core was subjected to vibration by an air hammer. As a result, the core 1 was completely collapsed or broken for within 30 to 60 seconds, while the casted product did not undergo surface penetration with the melted metal, but smooth casting surface was obtainable.

EXAMPLE 2

A core body 1a having a configuration shown in FIG. 3 was prepared. The core body 1a was formed of resin-coated sands which comprises 100 parts by weight of zircon sand having AFS Fineness No. 60, and 0.6 part by weight of phenol resin. The core body 1a provided collapsing strength of 30kgf/cm$^2$. The core body 1a was dipped into a first slurry for 3 seconds. The first slurry compositions were as follows:

zircon sand flour (having average particle size of 1 μm): 50 parts
zircon sand flour (having average particle size of 10μm): 20 parts
water: 15 parts
60% of urea resin solution: 7 parts
defoaming agent: several drips
sulfosuccinic acid sodium: 0.2 parts The core 1a coated with the first slurry was taken out and was heated at the temperature of 160° C. for 10 minutes for providing the first layer 2.

Then, 30% of urea resin solution was formed on the first layer 2 with a brush, and the brush-coated resin solution was left as it was at the temperature of 60° C. for 30 minutes for evaporating part of water, so that the second layer 3 which was not completely cured was formed over the first layer 2.

Thereafter, the core formed with dual layers was dipped into a second slurry for 2 seconds. The components of the second slurry were as follows:

natural mica: 10 parts
synthetic mica: 20 parts
sulfosuccinic acid sodium: 0.2 parts
water: 30 parts
defoaming agent: several drips Then the core was taken out from the second slurry and was heated at a temperature of 160° C. for 10 minutes for curing the second slurry, to thereby provide the third layer 4 over the second layer 3. As a result, a resultant core 1 shown in FIGS. 2 and 3 was provided.

Thus obtained core 1 was disposed in a metal mold cavity of a die casting machine (800 tons), and molten aluminum alloy (ADC10) having temperature of 680° C. was casted at casting pressure of 400 kgf/cm$^2$ and at plunger speed of 2.3 m/sec.(molten metal velocity 52m/sec.) into the mold cavity.

After casting, the core was subjected to vibration by an air hammer. As a result, the core 1 was completely collapsed or broken for within 30 to 60 seconds, while the casted product did not undergo surface penetration with the melted metal, but smooth casting surface was obtainable.

EXAMPLE 3

A core body 1a having a configuration shown in FIG. 3 was prepared. The core body 1a was formed of resin-coated sands which comprises 100 parts by weight of zircon sand having AFS Fineness No. 60, and 0.8 part by weight of phenol resin. The core body 1a provided collapsing strength of 40kgf/cm$^2$. The core body 1a was dipped into a first slurry for 2 seconds. The first slurry compositions were as follows:

silica sand flour (having average particle size of 1 μm): 50 parts
silica sand flour (having average particle size of 10μm): 20 parts
water: 50 parts
60% of urea resin solution: 10 parts
defoaming agent: several drips
sulfosuccinic acid sodium: 0.2 parts The core 1a coated with the first slurry was taken out and was heated at the temperature of 120° C. for 20 minutes for providing the first layer 2.

Then, 20% of phenol resin alcohol solution was formed on the first layer 2 with a brush, and the brush-coated resin solution was left as it was at the temperature of 60° C. for 10 minutes for evaporating greater parts of the alcohol, so that the second layer 3 which was not completely cured was formed over the first layer 2.

Thereafter, the core formed with dual layers was dipped into a second slurry for 2 seconds. The components of the second slurry were as follows:

natural mica: 20 parts
synthetic mica: 10 parts
sulfosuccinic acid sodium: 0.2 parts
water: 30 parts
defoaming agent: several drips Then the core was taken out from the second slurry and was heated at a temperature of 180° C. for 10 minutes for curing the second slurry, to thereby provide the third layer 4 over the second layer 3. As a result, a resultant core 1 shown in FIGS. 2 and 3 was provided.

Thus obtained core 1 was disposed in a metal mold cavity of a die casting machine (800 tons), and molten aluminum alloy (ADC10) having temperature of 670° C. was casted at casting pressure of 460 kgf/cm$^2$ and at plunger speed of 2 m/sec.(molten metal velocity 45m/sec.) into the mold cavity.

After casting, the core was subjected to vibration by an air hammer. As a result, the core 1 was completely collapsed or broken for within 30 to 60 seconds, while the casted product did not undergo surface penetration with the melted metal, but smooth casting surface was obtainable.

EXAMPLE 4

A core body 1a having a configuration shown in FIG. 3 was prepared. The core body 1a comprised 100 parts by weight of silica sand having AFS Fineness No. 60, and 2 part by weight of sodium silicate (water glass). The core body 1a was dipped into a first slurry for 2 seconds. The first slurry compositions were as follows:

silica sand flour (having average particle size of 1 μm): 40 parts
silica sand flour (having average particle size of 10μm): 20 parts
water: 40 parts
60% of urea resin solution: 10 parts
defoaming agent: several drips
sulfosuccinic acid sodium: 0.2 parts The core 1a coated with the first slurry was taken out and was heated at the temperature of 160° C. for 20 minutes for providing the first layer 2.

Then, 20% of phenol resin alcohol solution was formed on the first layer 2 with a brush, and the brush-coated resin solution was left as it was at the room temperature for 30 minutes for evaporating most of the alcohol, so that the second layer 3 which was not completely cured was formed over the first layer 2.

Thereafter, the core formed with dual layers was dipped into a second slurry for 2 seconds. The components of the second slurry were as follows:

natural mica: 20 parts
synthetic mica: 20 parts
sulfosuccinic acid sodium: 0.2 parts water: 30 parts
defoaming agent: several drips Then the core was taken out from the second slurry and was heated at a temperature of 180° C. for 10 minutes for curing the second slurry, to thereby provide the third layer 4 over the second layer 3. As a result, a resultant core 1 shown in FIGS. 2 and 3 was provided.

Thus obtained core 1 was disposed in a metal mold cavity of a die casting machine (800 tons), and molten aluminum alloy (ADC10) having temperature of 660° C. was casted at casting pressure of 460 kgf/cm$^2$ and at plunger speed of 1.8 m/sec.(molten metal velocity 41m/sec.) into the mold cavity.

After casting, the core was subjected to vibration by an air hammer. As a result, the core 1 was completely collapsed or broken for within 10 seconds, while the casted product did not undergo surface penetration with the melted metal, but smooth casting surface was obtainable.

EXAMPLE 5

A core body 1*a* having a configuration shown in FIG. 3 was prepared. The core body 1*a* was formed of resin-coated sand comprising 100 parts by weight of silica sand having AFS Fineness No. 50, and 1.3 part by weight of phenol resin. The core body had collapsing strength of 40 kg/cm$^2$. The core body 1*a* was dipped into a first slurry for 3 seconds. The first slurry compositions were as follows:

zircon sand flour (having average particle size of 1 μm): 70 parts
zircon sand flour (having average particle size of 10μm): 30 parts
water: 25 parts
30% of urea resin solution: 10 parts
defoaming agent: several drips
sulfosuccinic acid sodium: 0.3 parts The core 1*a* coated with the first slurry was taken out and was heated at the temperature of 60° C. for 20 minutes for providing the first layer 2.

Then, the core body 1*a* having the first layer was dipped in 40% of phenol resin alcohol solution for 1 second, and then left at room temperature for 30 minutes so as to evaporate a part of the alcohol content, (which evaporation did not provide complete curing of the phenol resin solution) so that the second layer 3 which was not completely cured was formed over the first layer 2.

Thereafter, the core formed with dual layers was dipped into a second slurry for 20 seconds. The components of the second slurry were as follows:

flaky natural mica: 20 parts
synthetic mica: 10 parts
water: 25 parts
sulfosuccinic acid sodium: 0.2 parts
defoaming agent: several drips Then the core was taken out from the second slurry and was heated at a temperature of 150° C. for 20 minutes for curing the second slurry, to thereby provide the third layer 4 over the second layer 3. As a result, a resultant core 1 shown in FIGS. 2 and 3 was provided.

Thus obtained core 1 was disposed in a metal mold cavity of a die casting machine (800 tons), and molten aluminum alloy (ADC10) having temperature of 680° C. was casted at casting pressure of 540 kgf/cm$^2$ and at plunger speed of 2.3 m/sec.(molten metal velocity of 52m/s) into the mold cavity.

After foundry, the core was subjected to vibration by an air hammer. As a result, the core 1 was completely collapsed or broken within 30 to 60 seconds, while the casted product did not undergo surface penetration with the melted metal, but smooth casting surface was obtainable.

EXAMPLE 6

A cold box type core body 1*a* having a configuration shown in FIG. 3 was prepared. The core body 1*a* was formed of blended sand comprising 100 parts by weight of silica sand having AFS Fineness No. 58, 0.4 parts by weight of phenol resin, and 0.4 parts of polyisocyanate. These composite blended sands underwent application of triethylamine gas. The core body 1*a* was dipped into a first slurry for 3 seconds. The first slurry compositions were as follows:

alumina flour (having average particle size of 1 μm): 50 parts
alumina flour (having average particle size of 8μm): 50 parts
water: 30 parts
45% of urea resin solution: 10 parts
defoaming agent: several drips
sulfosuccinic acid sodium: 0.2 parts The core 1*a* coated with the first slurry was taken out and was heated at the temperature of 100° C. for 10 minutes for providing the first layer 2.

Then, the core body 1*a* having the first layer was dipped in 10% of phenol resin alcohol solution for 2 seconds, and then left at temperature of 60° C. for 10 minutes so as to evaporate a part of the alcohol content, (which evaporation did not provide complete curing of the phenol resin solution) so that the second layer 3 which was not completely cured was formed over the first layer 2.

Thereafter, the core formed with dual layers was dipped into a second slurry for 3 seconds. The components of the second slurry were as follows:

flaky graphite: 10 parts
synthetic mica: 10 parts
water: 30 parts
sulfosuccinic acid sodium: 0.2 parts
defoaming agent: several drips Then the core was taken out from the second slurry and was heated at a temperature of 180° C. for 10 minutes for curing the second slurry, to thereby provide the third layer 4 over the second layer 3. As a result, a resultant core 1 shown in FIGS. 2 and 3 was provided.

Thus obtained cold box type core 1 was disposed in a metal mold cavity of a die casting machine (800 tons), and molten aluminum alloy (ADC10) having temperature of 660° C. was casted at casting pressure of 600 kgf/cm$^2$ and at plunger speed of 2.0 m/sec.(molten metal velocity of 45m/s) into the mold cavity.

After casting, the core was subjected to vibration by an air hammer. As a result, the core 1 was completely collapsed or broken for within 30 to 60 seconds, while the casted product did not undergo surface penetration with the melted metal, but smooth casting surface was obtainable.

EXAMPLE 7

A core body 1*a* having a configuration shown in FIG. 3 was prepared. The core body 1*a* was formed of resin-coated sand comprising 100 parts by weight of silica sand having AFS Fineness No. 60, and 1.8 part by weight of phenol resin. The core body had collapsing strength of 60 kg/cm$^2$. The core body 1*a* was dipped into a first slurry for 2 seconds. The first slurry compositions were as follows:

zircon sand flour (having average particle size of 1 μm): 50 parts
zircon sand flour (having average particle size of 10μm): 50 parts
water: 15 parts
20% or urea resin solution: 5 parts
defoaming agent: several drips
sulfosuccinic acid sodium: 0.2 parts The core 1*a* coated with the first slurry was taken out and was heated at the temperature of 120° C. for 10 minutes for providing the first layer 2.

Then, the core body 1*a* having the first layer was dipped in 30% of phenol resin alcohol solution for 1 second, and then left at room temperature for 20 minutes so as to evaporate a part of the alcohol content, (which evaporation did not provide complete curing of the phenol resin solution) so that the second layer 3 which was not completely cured was formed over the first layer 2.

Thereafter, the core formed with dual layers was dipped into a second slurry for 2 seconds. The components of the second slurry were as follows:

flaky aluminum powders: 20 parts
synthetic mica: 10 parts
water: 30 parts
sulfosuccinic acid sodium: 0.2 parts
defoaming agent: several drips Then the core was taken out from the second slurry and was heated at a temperature of 150° C. for 20 minutes for curing the second slurry, to thereby provide the third layer 4 over the second layer 3. As a result, a resultant core 1 shown in FIGS. 2 and 3 was provided.

Thus obtained core 1 was disposed in a metal mold cavity of a die casting machine (800 tons), and molten aluminum alloy (ADC10) having temperature of 680° C. was casted at casting pressure of 400 kgf/cm$^2$ and at plunger speed of 2.3 m/sec.(molten metal velocity of 52m/s) into the mold cavity.

After casting, the core was subjected to vibration by an air hammer. As a result, the core 1 was completely collapsed or broken for within 30 to 60 seconds, while the casted product did not undergo surface penetration with the melted metal, but smooth casting surface was obtainable.

In the foregoing examples, urea resin and phenol resin are used as the thermosetting resin as an essential component of the second layer. However, other equivallent thermosetting resins can be used such as furan resin, melamine resin, alkyd resin, unsaturated polyester resin and epoxy resin.

Figure 6:
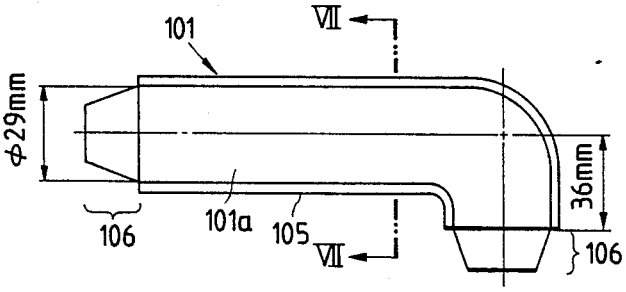
FIG. 6 is a front view showing a collapsible core produced by a method according to a second embodiment of this invention.

A second embodiment according to this invention will next be described with reference to FIGS. 6 thru 9. A collapsible core 101 of this embodiment includes a main body 101*a*, a first layer (internal layer) 102 formed over the external surface of the main body 101*a*, a second layer (intermediate layer) 103 formed over the first layer, and a third layer (outermost layer) 104 formed over the second layer 103. The main core body 101*a* is formed of refractory material and one of organic binder and inorganic binder. Further, as best shown in FIG. 8, the first layer 102 includes refractory material powders 102*a* and solvent such as water. The second layer 103 primarily contains thermosetting resin such as low temperature decomposable resin, for example, urea resin 103*a*. The third layer 104 contains aggregate agent 104*a* and solvent. The aggregate agent includes at least one of flaky graphite, mica and metal particles. In FIG. 6 reference numeal 105 generally designates triple layer portions 102,103 and 104, and reference numeal 106 designates end portions supported by a metal mold. The main core body 101*a* has a diameter of 29 mm, and is bent in L-shape. The one arm length is 36 mm, as shown.

For production of such collapsible core 101, a first slurry is prepared which comprises the refractory material powders and solvent. The core body 101*a* is dipped in the first slurry for about 5 seconds, and then taken out, and dryed at a temperature of 80° to 120° C. for about 5 to 10 minutes, so that the first layer 102 is formed over the core body 101*a*. Then a mixture of thermosetting resin and a solvent such as water is formed as the second layer 103 by dipping, spray-coating or brush-painting over the first layer. The core body formed with dual layers is dipped for 1 to 2 seconds in a second slurry which comprises the aggregate agent and solvent. This dipping is performed prior to complete curing of the second layer. That is, the solvent in the mixture of the second layer is evaporated under control so as to avoid complete curing of the second layer for the subsequent process for providing the third layer. The core body is taken out and the second slurry adhered thereon is dryed at temperature of 150° to 180° C. for about 5 to 10 minutes, so that the second slurry is solidified as the third layer 104.

With the structure and method in the second embodiment, the thermosetting resin solution 103*a* is penetrated into the first layer formed mainly of refractory material powders. After imcomplete evaporation of solvent of the thermosetting resin solution 103*a*, the thermosetting resin (uncured) also penetrates into the third layer when the latter is provided over the second layer. Upon heating and solidification, the first and third layers are tightly bonded through the intermediate second layer. Therefore, these layers are not washed out by the molten metal, and surface penetration of the core with the molten metal is avoidable. Further, if urea resin is used as the second layer, which urea resin provides sufficient heat decomposition at a temperature of 300° to 400° C. as is apparent from FIG. 9, these layers are easily collapsible during casting by the heat of molten metal. Further, since the thermosetting resin is formed by dipping spraying or brushing, the resin is not excessively transmitted into the interior of the core main body 101*a*. As a result, the core 101 has sufficient collapsibility after casting.

Examples according to the second embodiment will be described.

EXAMPLE 8

Figure 7:
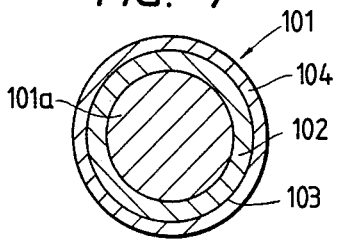
FIG. 7 is a cross-sectional view taken along the line VII-VII of FIG. 6.
Figure 8:
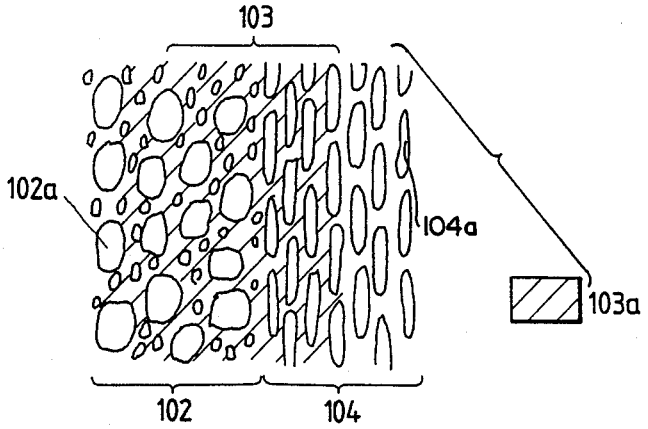
FIG. 8 is an enlarged cross-sectional view showing coating layers according to the second embodiment of this invention; and, FIG. 9 is a graphical representation showing thermogravimetric analysis with respect to urea resin (low temperature decomposable resin).
Figure 9:
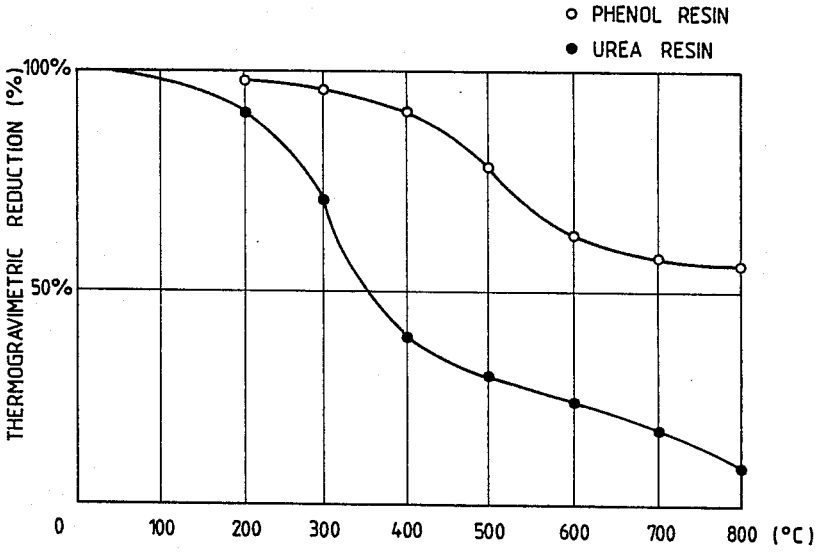

A core body 101*a* having a configuration shown in FIG. 7 was prepared. The core body 101*a* was formed of resin-coated sands which comprises 100 parts by weight of zircon sand having AFS Fineness No. 54, 0.2 parts by weight of collapsible agent (tetrabromobisphenol A), and 0.8 part by weight of phenol resin. The core body 101*a* provided collapsing strength of 40kgf/cm$^2$. The core body 1*a* was dipped into a first slurry for 5 seconds. The first slurry compositions were as follows:

silica sand flour (having average particle size of 1 μm): 50 parts
silica sand flour (having average particle size of 10μm): 20 parts water: 48 parts
defoaming agent: 0.1 parts
sulfosuccinic acid sodium: 0.2 parts
The core 101*a* coated with the first slurry was taken out and was heated at the temperature of 120° C. for 10 minutes for providing the first layer 102.

Then, the core body 101*a* formed with the first layer 102 was dipped into 20% of urea resin solution for 5 seconds, and was dryed at room temperature for 15 minutes. In this drying, water in the resin solotion was not completely evaporated so as to avoid complete curing of the second layer.

Thereafter, the core formed with dual layers was dipped into a second slurry for 2 seconds. The components of the second slurry were as follows:
flaky graphite: 30 parts
aluminum powders: 10 parts
sulfosuccinic acid sodium: 0.5 parts
water: 50 parts
defoaming agent: 0.1 parts Then the core was taken out from the second slurry and was heated at a temperature of 150°0 C. for 10 minutes for curing the second slurry, to thereby provide the third layer 104 over the second layer 103. As a result, a resultant core 101 shown in FIG. 6 was provided.

Thus obtained core 101 was disposed in a metal mold cavity of a die casting machine (500 tons), and molten aluminum alloy (ADC10) having temperature of 720° C. was casted at casting pressure of 500 kgf/cm$^2$ and at plunger speed of 2 m/sec. into the mold cavity.

After casting, the core was subjected to vibration by an air hammer. As a result, the core 101 was completely collapsed or broken for within 30 to 60 seconds, while the casted product did not undergo surface penetration with the melted metal, but smooth casting surface was obtainable.

EXAMPLE 9

Figure 1:
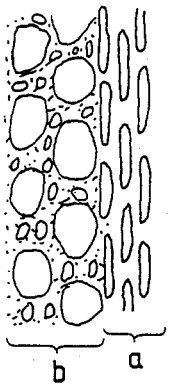
FIG. 1 PRIOR ART
FIG. 1 is an enlarged cross-sectional view showing coating layers of a conventional collapsible core.
Figure 4:
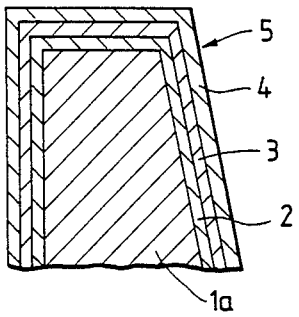
FIG. 4 is an enlarged cross-sectional view showing a circle portion A of FIG. 3.
Figure 2:
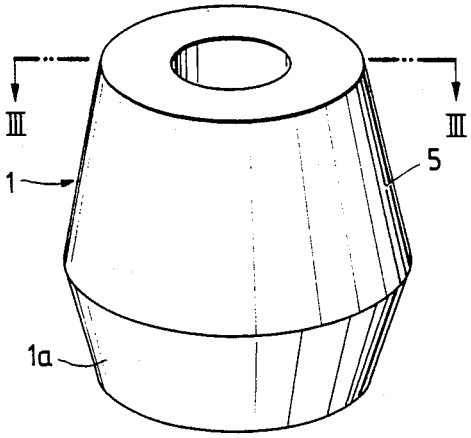
FIG. 2 is a perspective view showing a collapsible core according to one embodiment of this invention.

A core body 101*a* having a configuration shown in FIGS. 2 and 3 was prepared. The core body 101*a* was formed of resin-coated sands which comprises 50 parts by weight of silica sand having AFS Fineness No. 58, 50 parts by weight of silica sands having AFS Fineness No. 32, 0.2 parts by weight of collapsible agent (tetrabromobisphenol A), and 1.2 parts by weight of phenol resin. The core body 101*a* provided collapsing strength of 30kgf/cm$^2$. The core body 1*a* was dipped into a first slurry for 5 seconds. The first slurry compositions were as follows:
zircon sand flour (having average particle size of 1 μm): 50 parts
zircon sand flour (having average particle size of 10μm): 20 parts
water: 30 parts
defoaming agent: several drips
sulfosuccinic acid sodium: 0.3 parts
The core 101*a* coated with the first slurry was taken out and was heated at the temperature of 120° C. for 10 minutes for providing the first layer 102.

Then, the core body 101*a* formed with the first layer 102 was formed with 20% of urea resin solution by a brush, and was dryed at room temperature for 30 minutes for evaporating parts of water in the urea resin solution. This water evaporation was carried out so as to avoid complete curing of the second layer.

Thereafter, the core formed with dual layers was dipped into a second slurry for 1 seconds. The components of the second slurry were as follows:
natural mica: 20 parts
synthetic mica: 10 parts
sulfosuccinic acid sodium: 0.2 parts
water: 30 parts
defoaming agent: several dripps.

Then the core was taken out from the second slurry and was heated at a temperature of 180° C. for 10 minutes for curing the second slurry, to thereby provide the third layer 104 over the second layer 103. As a result, a resultant core 101 shown in FIGS. 2 and 3 was provided.

Thus obtained core 101 was disposed in a metal mold cavity of a die casting machine (800 tons), and molten aluminum alloy (ADC10) having temperature of 720° C. was casted at casting pressure of 460 kgf/cm$^2$ and at plunger speed of 1.8 m/sec. into the mold cavity.

After casting, the core was subjected to vibration by an air hammer. As a result, the core 101 was completely collapsed or broken for within 1 to 2 minutes, while the casted product did not undergo surface penetration with the melted metal, but smooth casting surface was obtainable.

EXAMPLE 10

A core body 101*a* having a configuration shown in FIGS. 6 and 7 was prepared. The core body 101*a* comprised 100 parts by weight of zircon sand having AFS Fineness No. 54, and 2 parts by weight of sodium silicate (water glass). The core body 101*a* provided collapsing strength of 30kgf/cm$^2$. The core body 101*a* was dipped into a first slurry for 5 seconds. The first slurry compositions were as follows:
alumina (aluminium oxide)((having average particle size of 4 μm): 50 parts
alumina (aluminum axide) (having average particle size of 1 μm): 20 parts
methanol (methyl alcohol): 100 parts
The core 101*a* coated with the first slurry was taken out and was heated at the temperature of 80° C. for 5 minutes for providing the first layer 102.

Then, the core body 101*a* formed with the first layer 102 was formed with 30% of urea resin solution by spraying, and was dryed at a temperature of 50° C. for 15 minutes for evaporating part of water yet avoiding complete curing of the sprayed layer.

Thereafter, the core formed with dual layers was dipped into a second slurry for 2 seconds. The components of the second slurry were as follows:
aluminum powder: 20 parts
synthetic mica: 10 parts
sulfosuccinic acid sodium: 0.5 parts
water: 30 parts
defoaming agent: several dripps.

Then the core was taken out from the second slurry and was heated at a temperature of 180° C. for 5 minutes for curing the second slurry, to thereby provide the third layer 104 over the second layer 103. As a result, a resultant core 101 shown in FIG. 6 was provided.

Thus obtained core 101 was disposed in a metal mold cavity of a die casting machine (500 tons), and molten aluminum alloy (ADC10) having temperature of 720° C. was casted at casting pressure of 500 kgf/cm$^2$ and at plunger speed of 2 m/sec. into the mold cavity.

After casting, the core was subjected to vibration by an air hammer. As a result, the core 101 was completely collapsed or broken for within 30 to 60 seconds, while the casted product did not undergo surface penetration with the melted metal, but smooth casting surface was obtainable.

In view of the foregoing, according to the present invention, the layers formed over the core body are not washed out even by the application of melt flow having high speed high pressure in the die casting machine. Further, the layers do not undergo surface penetration with melted metal. Further, excellent outer apearance, dimensional accuracy and shape are obtainable in the resultant casted product because of elimination of sand baking.

In the above embodiments, the first layer is provided over the main core body by dipping the same in the first slurry. Hoever, the first slurry can also be provided over the main core body by spray-coating or by brush-painting. The same is true with respect to the third layer. That is, instead of dipping the main core body having the dual layers into the second slurry for forming the third layer, the second slurry can be formed over the second layer by spray-coating or brush-painting.

While the invention has been described in detail and with reference to specific embodiments thereof, it would be apparent for those skilled in the art that various changes and modifications can be made therein without deaprting from the spirit and scope of the invention.

What is claimed is:

1. A collapsible core for use in a casting, said core including a main core body, said collapsible core comprising:

said main core body being formed of refractory materials and at least one of organic binder and inorganic binder;

a first layer formed over an external surface of said main core body, said first layer containing refractory material powders;

a second layer formed over said first layer, said second layer including thermosetting resin; and, a third layer formed over said second layer, said third layer being formed of at least one of flaky graphite, mica and metallic powder.

2. The collapsible core as defined in claim 1, wherein said first layer comprises said refractory material powders, and a low temperature decomposable resin comprising a urea resin; and wherein said thermosetting resin in said second layer comprises one of urea resin and phenol resin.

3. The collapsible core as defined in claim 1, wherein said first layer comprises said refractory material, and wherein said thermosetting resin in said second layer comprises a low temperature decomposable resin comprising a urea resin.

4. The collapsible core as defined in claim 1, wherein said third layer comprises a mixture of a solvent and at least one of said flaky graphite, said mica and said metallic powder.

5. A method for producing a collapsible core for use in a casting, said core including a main core body, said method comprising the steps of:

preparing said main core body formed of refractory materials and at least one of organic binder and inorganic binder;

preparing a first slurry formed of a mixture of refractory material powders and a first solvent;

providing said first slurry over said main core body for forming a first layer over said main core body, drying said first layer;

applying a mixture of a resin material and a second solvent onto said first layer for forming a second layer over said first layer;

preparing a second slurry formed of a mixture of a third solvent and at least one of flaky graphite, mica and metallic powders;

forming said second slurry over said second layer prior to complete curing of said second layer for providing a third layer over said second layer; and, heating and curing said second and third layers.

6. The method as defined in claim 5, further comprising the step of controlling evaporation of said second solvent in said second layer after said applying step to avoid complete curing of said second layer for subsequent said dipping step.

7. The method as defined in claim 5, wherein said first slurry further includes a low temperature decomposable resin.

8. The method as defined in claim 7, wherein said low temperature decomposable resin comprises urea resin.

9. The method as defined in claim 5, wherein said resin material in said applying step is a thermosetting resin, said thermosetting resin comprising one of urea resin and phenol resin.

10. The method as defined in claim 5, wherein said resin material in said applying step comprises a thermosetting resin solution, and wherein said applying step is performed by coating said resin material over said first layer.

11. The method as defined in claim 10, wherein said coating is performed by dipping said main core body formed with said first layer into said thermosetting resin solution.

12. The method as defined in claim 10, wherein said coating is performed by spraying said thermosetting resin solution onto said first layer.

13. The method as defined in claim 10, wherein said coating is performed by painting said thermosetting resin solution over said first layer with a brush.

14. The method as defined in claim 5, wherein said resin material in said applying step comprises low temperature decomposable resin.

15. The method as defined in claim 14, wherein said low temperature decomposable resin comprises urea resin solution.

16. The method as defined in claim 5, wherein said providing step is performed by dipping said main core body into said first slurry.

17. The method as defined in claim 5, wherein said providing step is performed by spray-coating said first slurry over said main core body.

18. The method as defined in claim 5, wherein said providing step is performed by painting said first slurry over said main core body with a brush.

19. The method as defined in claim 5, wherein said forming step is performed by dipping said main core body having said first and second layers into said second slurry.

20. The method as defined in claim 5, wherein said forming step is performed by spray-coating said second slurry over said second layer.

21. The method as defined in claim 5, wherein said forming step is performed by painting said second layer with said second slurry by a brush.

* * * * *